US006065901A

United States Patent [19]

Stevens et al.

[11] Patent Number: 6,065,901

[45] Date of Patent: May 23, 2000

[54] SYSTEM AND METHOD OF GAS DISPERSAL AND COLLECTION FOR PREVENTING GAS CONTAMINATION

[75] Inventors: Richard Stevens, Canterbury; Paul Nichols, Falmouth; Malcolm Martin, Ashford, all of United Kingdom

[73] Assignee: Prestige Air Technology Limited, United Kingdom

[21] Appl. No.: 08/809,861

[22] PCT Filed: Oct. 5, 1995

[86] PCT No.: PCT/GB95/02364

§ 371 Date: Apr. 2, 1997

§ 102(e) Date: Apr. 2, 1997

[87] PCT Pub. No.: WO96/11304

PCT Pub. Date: Apr. 18, 1996

[30] Foreign Application Priority Data

Oct. 5, 1994 [GB] United Kingdom ..... 9420084

[51] Int. Cl.[7] ..... E02B 13/00

[52] U.S. Cl. ..... 405/52; 405/53; 405/128; 405/270; 588/249; 52/169.1; 454/909

[58] Field of Search ..... 405/52, 53, 128, 405/129, 270; 588/249; 210/747, 170; 52/169.1, 169.11, 169.14, 169.5; 454/909

[56] References Cited

U.S. PATENT DOCUMENTS

| | | | |
|---|---|---|---|
| 4,501,788 | 2/1985 | Clem | 428/240 |
| 4,620,398 | 11/1986 | Wallin | 405/131 X |
| 4,768,897 | 9/1988 | Nussbaumer et al. | 405/123 |
| 4,838,733 | 6/1989 | Katz | 405/129 |
| 4,938,124 | 7/1990 | Garza | 454/909 X |
| 4,943,185 | 7/1990 | McGuckin et al. | 52/169.14 X |
| 4,956,951 | 9/1990 | Kannankeril | 52/169.14 X |
| 4,988,237 | 1/1991 | Crawshaw | 454/909 X |
| 5,003,750 | 4/1991 | Delgado | 454/909 X |
| 5,067,852 | 11/1991 | Plunkett | 405/128 |
| 5,206,067 | 4/1993 | Bonzo | 405/129 X |
| 5,265,979 | 11/1993 | Hansen | 405/129 |

FOREIGN PATENT DOCUMENTS

| | | | |
|---|---|---|---|
| 92018261 | 10/1992 | WIPO | 405/53 |

*Primary Examiner*—David J. Bagnell
*Assistant Examiner*—Jong-Suk Lee
*Attorney, Agent, or Firm*—Gifford, Krass, Groh, Sprinkle, Anderson & Citkowski, P.C.

[57] ABSTRACT

A system for use in preventing a flow of gas from a gas-containing region (20) to an adjacent region (22) and/or for collecting or dispersing gas at the interface between the regions, comprising a composite barrier (10) installed so as to separate the two regions (20, 22), the barrier (10) comprising a gas-impermeable layer (11) and a gas-permeable membrane (12) interconnected so as to define an interspace (16) between them and arranged with the permeable layer (12) facing the region containing gas (20) to be dispersed or collected. A method is also described comprising the steps of connecting an aperture (36) or aperture of the barrier communicating with the interspace (16) thereof to pumping means (37) which, in operation, act to pump gas into or out from the interspace (16) by creating a pressure differential across the permeable membrane such as to cause gas to flow therethrough across a major proportion of its surface area.

4 Claims, 3 Drawing Sheets

SYSTEM AND METHOD OF GAS DISPERSAL AND COLLECTION FOR PREVENTING GAS CONTAMINATION

FIELD OF THE INVENTION

The present invention relates to the dispersal and/or collection of gases permeating large volumes of material, such as harmful or inflammable gases permeating the ground in general.

BACKGROUND OF THE INVENTION

As technology improves and more advanced testing is carried out, there is an increasing awareness that the ground around us may be permeated by gases such as radon or hydrocarbons which are injurious to health or may cause an explosion if allowed to concentrate in enclosed volumes, such as buildings. Such gases may be naturally occurring or produced for example by reactions in landfill sites.

Particularly in the latter case, there is a need to ensure, before the sites are commissioned, that measures are taken to prevent the gases from escaping into the surrounding terrain, both for safety reasons and because the gases are themselves a valuable asset, being usable as a fuel to generate power.

One measure which is currently used to prevent the spread and accumulation of underground gases is to dig a trench along a selected boundary of the contaminated ground, to line the side of the trench opposite the contaminated ground with gas-impermeable sheeting and to fill the trench with loose aggregate to provide a vent. The intention is that any gases reaching the trench will permeate up through the aggregate and will be dispersed into the atmosphere along its entire length, avoiding any build up in a particular area and preventing the further spread of the gases.

A problem which is found with this arrangement is that trenches tend to silt up over long periods of time to the extent that the aggregate loses its permeability in certain areas and the gases tend to be channelled along defined routes to exit from the trench at discrete locations rather than along its entire surface. Thus, in time, the trench promotes a concentration of gas in the atmosphere at certain locations, exactly the effect that it is intended to stop.

A further problem with the use of trenches is that, being designed to disperse gases into the atmosphere they do not assist in the collection of gases which are usable as a fuel or which, because of their harmful nature, should be contained rather than discharged.

SUMMARY OF THE INVENTION

An object of the present invention is, therefore, to provide an alternative method of venting such ground-emanating or other gases which is more effective in the long term and more versatile in enabling either the collection or dispersal of gases to be achieved relatively simply.

Accordingly the present invention provides, in one aspect a method of preventing a flow of gas from a gas-containing region to an adjacent region and for collecting or dispersing gas at the interface between the regions, comprising installing between the two regions a barrier comprising a gas-impermeable layer and a gas-permeable membrane interconnected so as to define an interspace between them, and arranging the barrier with the permeable layer facing the region containing gas to be dispersed or collected, connecting an aperture or apertures of the barrier communicating with the interspace to a pump means for pumping gas into or out from the interspace, and creating, by the pump means, a pressure differential across the permeable membrane such as to cause gas to flow therethrough across a major proportion of its surface.

In a further aspect, the invention provides a system for preventing a flow of gas from a gas-containing region to an adjacent region and for collecting or dispersing gas at the interface between the regions, comprising a barrier installed so as to separate the two regions, the barrier comprising a gas-impermeable layer and a gas-permeable membrane interconnected so as to define an interspace between them and arranged with the permeable layer facing the region containing gas to be dispersed or collected, and a pump means connected to an aperture or apertures of the barrier communicating with the interspace for pumping gas into or out from the interspace so as to create a pressure differential across the permeable membrane such as to cause gas to flow there through across a substantial proportion of its surface.

The barrier may, for example, be installed in a vent trench as described above to replace the current gas-impermeable sheeting, the impermeable layer being waterproof as well as gas proof. In this case gas, usually air, may be pumped into the interspace in use to cause air to flow from the interspace through the permeable membrane into the adjoining ground where it would tend to rise up along the outer face of the membrane, carrying with it any soil gases and dispersing them into the atmosphere. The advantage of this method over the use of a prior art vent trench is that the active ventilation of the barrier prevents silting up so that venting is not compromised in the long term. This safety factor outweighs any increased costs there may be in installing and operating the barrier.

Alternatively the barrier may be located in a similar situation but adapted for use in the collection of gases. In this case the pump means are operated to suck gas from the interspace so as to cause the gases permeating the adjacent ground to flow into the interspace and from there through the aperture or apertures into ducts arranged to carry them to a collecting or treatment vessel.

A major factor in the effectiveness of the method of the invention is the selection of the barrier itself. This must be capable of withstanding the mechanical pressures and chemical action to which it is likely to be subject in its particular location of use. Plastics materials are preferred. In addition the flow cross-section of the interspace, or of channels defining the interspace, must be sufficiently large in relation to the pore size of the permeable membrane to allow substantially free flow of gas through the interspace in comparison with that through the membrane. This is to ensure that there is no substantial preferential transfer of gas across the membrane close to the aperture or apertures at the expense of passage through parts remote therefrom. There will, inevitably, be a pressure drop between any one aperture and remote parts of a membrane but an appropriate pressure differential across the entirety of a membrane may be achieved by the provision of a plurality of inlet or outlet apertures at suitable spacings.

The actual flow created through the membrane would in most cases be relatively weak but it will readily be appreciated that the pump means may be controllable to give any desired flow rate. Moreover a monitoring system may be provided for monitoring the pressure, flow rates, gas concentrations or other factors, at various points within the barrier or in the adjacent gas-containing region. The reading may then be used to adjust the flow created by the pump means to achieve a desired gas migration through the region and across the barrier membrane itself: control of the system would preferably be automatic, by means of an electronic control unit.

Both the impermeable layer and the permeable membrane of the barrier may be of relatively rigid or flexible, but preferably not resilient, material. If rigidity is required, this may be provided by a suitably open structure interconnecting the two layers. The permeable membrane may, for example, be a perforated sheet of solid plastics material, the perforations being made during or after the sheet is made, whether by extrusion, moulding or other technique or it may comprise a sheet of foamed plastics material with an open-cell structure or a closely-woven textile. In a preferred embodiment, however, it comprises a non-woven textile of artificial fibres or filaments, preferably NYLON, particularly the fabric sold under the trade name GEOTEX.

The interconnecting open structure may comprise an open latticework, possibly an open-cell foam, which defines ducts or spaces interconnecting in all directions to define the said interspace of the barrier: such spaces must be of much larger order of magnitude than the pores of the porous membrane so as to allow a free flow of gas there through. Alternatively the interconnecting open structure may define distinct channels separated from each other by walls so as to define directed flow paths for gas within the barrier.

The barrier aperture or apertures connected to the pump means may open from any part of the interspace, whether at the centre or at an edge but preferably the latter. Furthermore the periphery of the barrier may be sealed except at the aperture or apertures connected to the pump means or alternatively the interspace within the barrier may open at the edge of the barrier into peripheral ducts communicating with the said aperture or apertures.

Although, as indicated above, the barrier may be constructed in various ways, a particularly simple and convenient form comprises a substantially rigid impermeable sheet formed with a plurality of spaced projections on one face to which is adhered the permeable membrane, the spaces between the projections intercommunicating and defining the said interspace of the barrier. Even more preferably the projections may be formed by press-moulding of the sheet, there being corresponding recesses in its opposite face. One example of such a barrier, which is particularly suitable for the present purpose is made by Servicised Limited under the name SERVIDRAIN 200. This comprises a substantially stiff polyethylene impermeable sheet formed with a plurality of cylindrical studs or bosses projecting from one face in a regular array. The studs or bosses have significant strength against collapse and each has a closed end face substantially coplanar with the end faces of the other studs or bosses to receive a mat of nonwoven nylon or other permeable membrane adhered thereto.

As indicated above, the barrier may be used in a trench for venting ground-contaminating gases, but it is not limited to use in a vertical position. Indeed, it may be installed horizontally or at any angle to the horizontal or indeed may be curved. Furthermore, any one barrier may be arranged to communicate at its edges with similar such barriers either coplanar with it or arranged at an angle: in particular it is envisaged that such barriers, whether intercommunicating or independent, may be installed so as to surround or partially surround a given volume providing a base and/or one or more sides and possibly also a cover. The barrier may be installed with the permeable membrane facing into or out of the given volume according to whether it is wished to trap gas inside it or prevent infiltration from outside. It may be useful in certain circumstances to provide a permeable membrane on both sides of an impermeable membrane in which case two such barriers may be used back-to-back, or a single barrier may be modified by the attachment of a permeable membrane to both faces, with, of course, suitable creation of an interspace on both sides.

In the majority of currently envisaged installations, the barrier will be used to contain a gas within a region of ground and will be required to be waterproof and impervious to the gas specified, whether radon, hydrocarbons or toxic gases such as sulphur or nitrogen-containing compounds or halogenated organic compounds. The barrier may, however, be designed for a multitude of other uses, such as to contain spillages of liquid oil or chemicals and to disperse or collect their vapours or to prevent the admixture of gases from the surrounding area with such contaminants. All such uses will require a choice of materials for the barrier which will not be attacked by the chemicals involved and which are within the competence of the man skilled in the art.

It will also be appreciated that, in most cases, the system of the invention will be arranged either to disperse gases from a given region by pumping gas through the barrier and into the region or it will be arranged to collect gases, by suction through the barrier and the provision of appropriate collecting means. Clearly, however, the system is very versatile and may be arranged to effect either dispersal or collection by reversal or substitution of the pump means to reverse the gas flow.

Such reversal may be particularly useful, for example, if it is wished to clean a permeable membrane used in a suction system which has become clogged with fine particles. Air (or other fluid) may thus be passed through the membrane in the opposite direction to blow off the accumulated debris.

If necessary the integrity of the barrier may be tested from time to time, particularly in regions in which it is vulnerable to attack by chemicals, vermin, bacteria or other pests or phenomena. In this event, a gas which is detectable in extremely small concentrations may be pumped into the interspace of the barrier and probes may be located at suitable points on either side of the barrier to detect the presence of the gas.

BRIEF DESCRIPTION OF THE DRAWINGS

Several embodiments of the invention will now be more particularly described, by way of example, with reference to the accompanying drawings, in which.

DETAILED DESCRIPTION OF THE PREFERRED EMBODIMENTS

Figure 1:
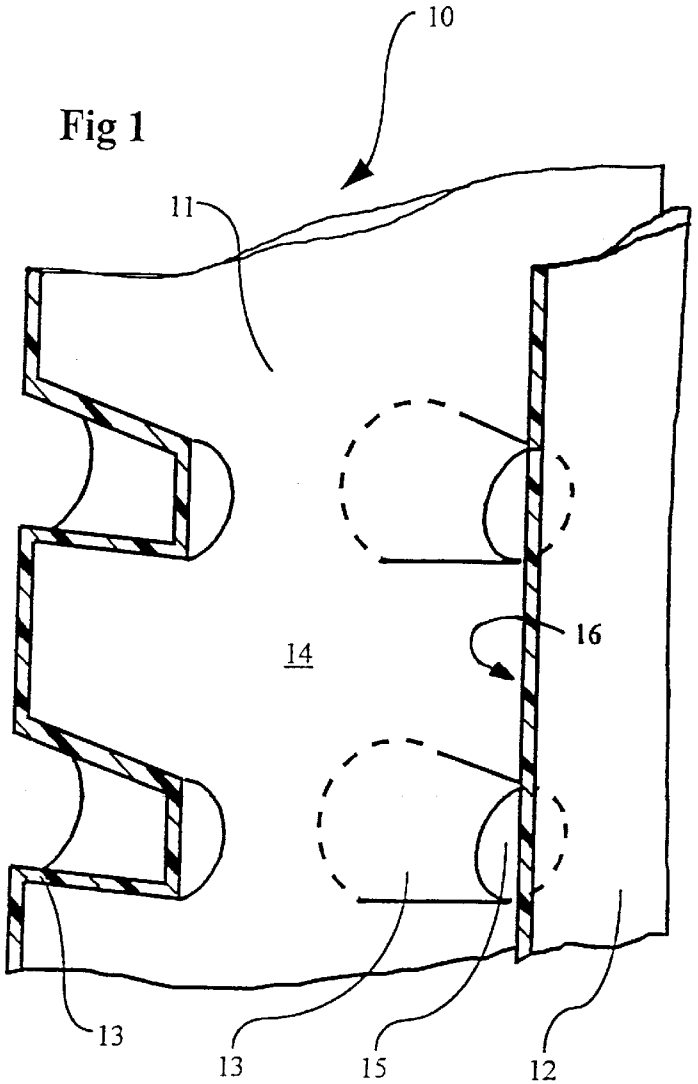
FIG. 1 is a diagrammatic cut-away perspective view of part of a barrier for use in a system of the invention.

With reference to FIG. 1, a barrier for use in a system according to the invention is shown generally indicated 10. The barrier 10 is constituted by two layers, a gas- and water-impermeable sheet 11 and a gas-permeable non-woven textile membrane 12.

The sheet 11 is made from a flat sheet of polyethylene which is press-moulded such as to have a regular array of spaced projections 13 upstanding from one face 14 thereof. The projections 13 are generally cylindrical but with a slight taper for ease of moulding and with substantially flat, coplanar tops 15 parallel to the face 14. The projections 13 are spaced apart by distances slightly greater than their diameters. They are shown arranged in a rectangular lattice array, that is, in mutually perpendicular lines and rows, but could be in any array, whether regular or irregular, provided that there are substantial, interconnecting air spaces between them, which together constitute an interspace 16.

The membrane 12 comprises a mat of nylon fibres which is adhered to the flat tops 15 of the projections 13 so as to define the interspace 16 between the membrane 12, the face 14 of the sheet 11 and the projections 13.

The barrier 10 is formed as a panel which may be manufactured individually or cut from a larger sheet. Before use, it may be sealed around its entire periphery or along parts thereof. Apertures may be left or formed at the periphery and/or centrally of the panel for connection to appropriate pumping equipment for pumping air into or out from the interspace 16.

Figure 2:
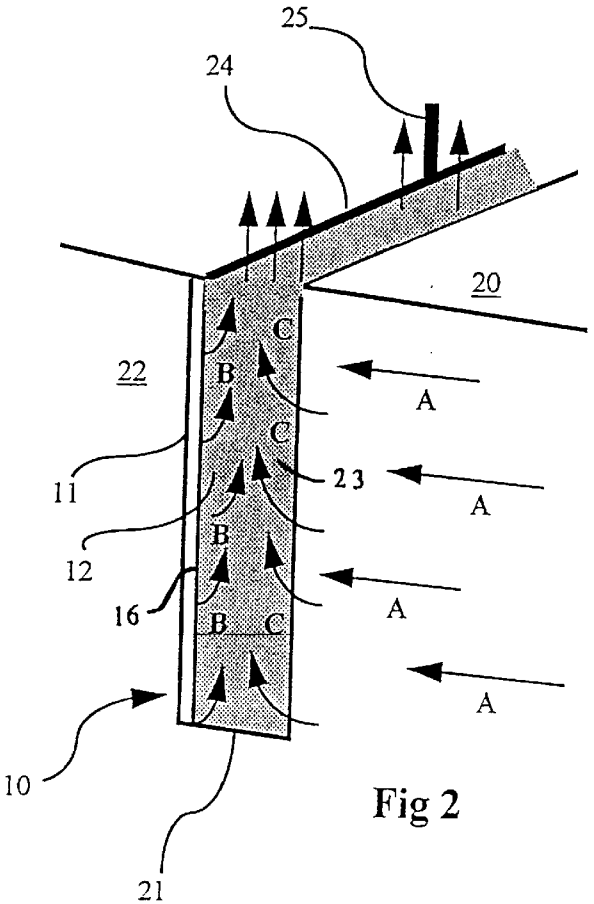
FIG. 2 is a diagrammatic sectional view through a vent trench incorporating the barrier of FIG. 1.

With reference to FIG. 2 of the drawings, this shows a region of the ground generally indicated 20 containing contaminant gases seeping generally in a direction indicated by the arrows A. A vertical trench 21 is dug into the ground across the path of the contaminant gases, between the contaminated region 20 and an adjacent region 22 which is intended to project. The opposite side of the trench 21 from the ground 20 is covered by a continuous sheathing of the barrier 10 of FIG. 1, shown only schematically here. The barrier 10 is arranged with its impermeable sheet 11 in contact with the trench wall which bounds the ground region 22 and its permeable membrane 12 facing into the trench 21. The trench itself is backfilled with pea shingle 23 or other coarse granular material.

The bottom and side edges of the barrier 10 are all sealed but a manifold 24 is provided along the top edge and connected via a duct 25 to pumping equipment (not shown) for pumping air into or out from the interspace 16 of the barrier 10.

In use, air pumped into the barrier 10 flows through the interspace 16, permeates through the membrane 12, as shown by the arrows B, and rises up through the pea shingle 23 to the surface. As gas reaches the trench 21 from the contaminated ground 20, it is unable to pass through the barrier 10 because of its impermeable backing sheet 11 and also rises to the surface as indicated by the arrows C, assisted by the flow of the air through the membrane 12. Thus spread of the contaminating gases to the ground region 22 is prevented, and an active distribution of the gases along the trench is achieved thereby avoiding unwanted local concentrations.

Figures 3, 4:
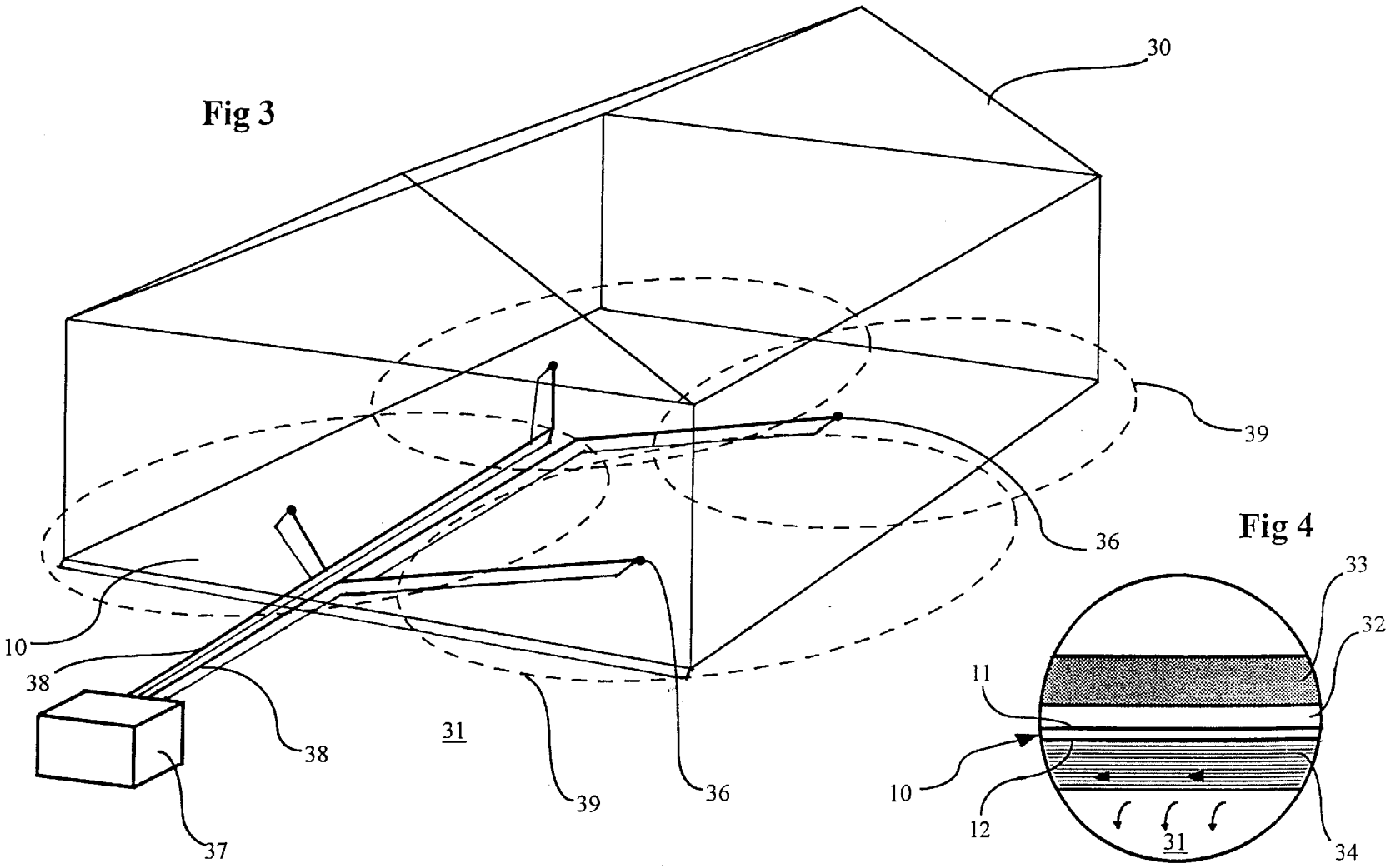
FIG. 3 is a diagrammatic perspective view of a first embodiment of a system according to the invention installed to prevent seepage of gas from the ground into a building.
FIG. 4 is an enlarged sectional view of part of the floor of the building of FIG. 3 and the ground on which it is built.

With reference now to the FIGS. 3 and 4 of the drawings, these show a building 30 located over a region of ground 31 contaminated by noxious gas such as radon. A barrier 10 has been laid over the entire ground area covered by the building 30, and, specifically, beneath a 50 mm thick blinding layer 32 beneath the floor slab 33 and on top of a layer of pea shingle 34. The barrier 10 is laid with the permeable membrane 12 being on its underside.

As best seen in FIG. 3, diffusers are connected to apertures 36 in the impermeable sheet 11 at spaced locations and connected to pumping equipment 37 by branched ducts 38. In use, the pumping equipment 37 delivers air under pressure to each inlet aperture 36 from where it spreads radially through the interspace 16 and permeates out through the membrane 12 into the contaminated ground 31. This active flow of air, together with the presence of the impermeable sheet 11, prevents the contaminated gas from rising up into the building 30; the gas flow is deflected along the underside of the permeable membrane to the ground outside the building itself.

The extent to which air spreads from each inlet diffuser 36 through the interspace 16 to achieve a delivery through the membrane 12 into the ground 31 is indicated by the circles of dashed lines 39 around each diffuser 36; each circle may be termed the boundary of the zone of influence of the respective inlet. To achieve effective ventilation of the entire area under the building 30, these zones of influence should at least touch and should preferably overlap, as shown in FIG. 3. It will be appreciated that this drawing shows, purely schematically, a rectangular building with the diffusers 36 located substantially in the centres of the four rectangles into which the building is divided by two orthogonal planes of symmetry. The number and arrangement of inlets may, of course, be varied in accordance with the size and shape of the building.

Figure 5:
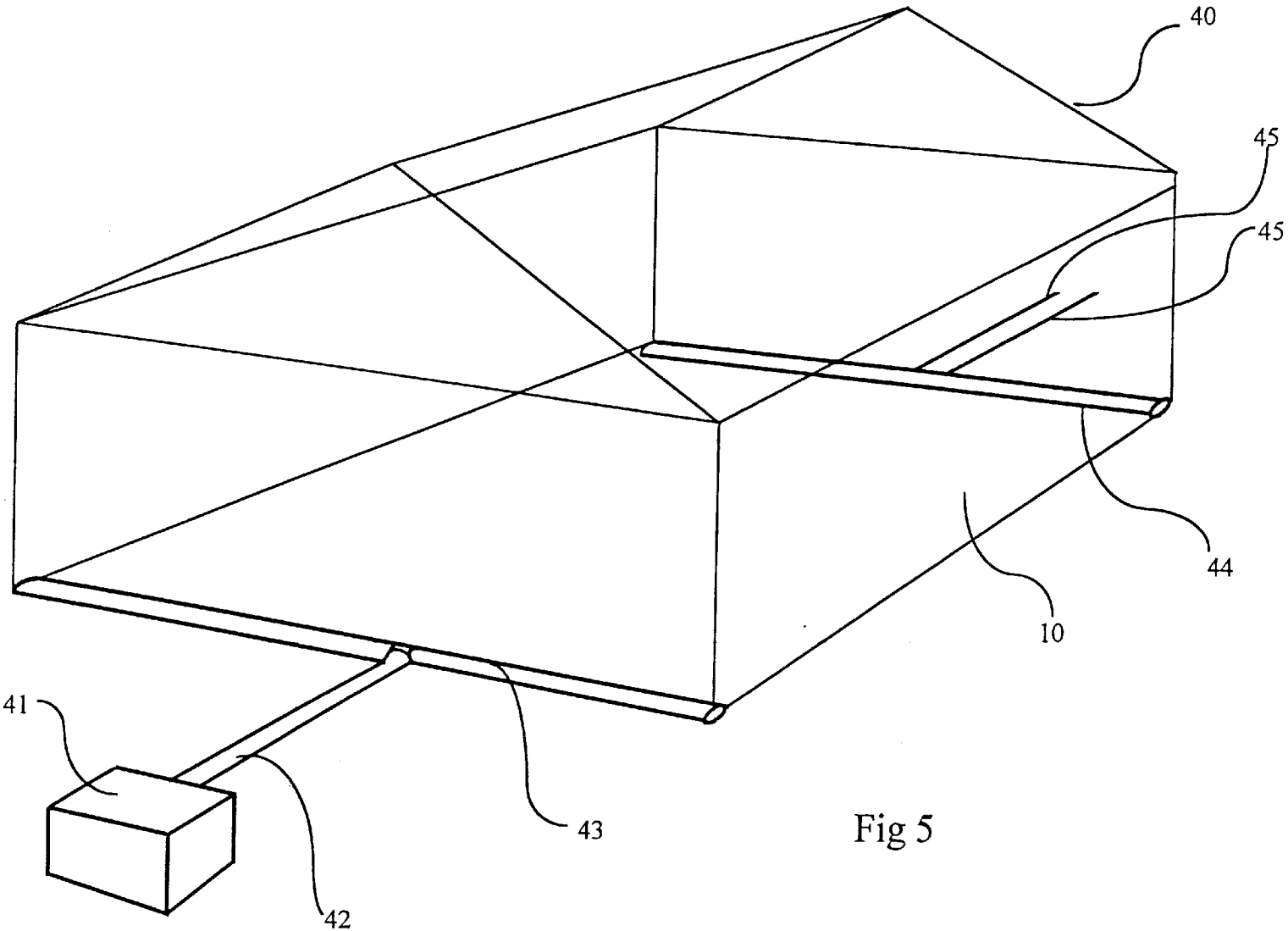
FIG. 5 is a view similar to FIG. 3 showing a second embodiment of the system of the invention.

With reference to FIG. 5, this shows an alternative arrangement for preventing gas from seeping up into a building. In this arrangement the barrier 10 is laid beneath the floor of a building 40 as in the arrangement of FIGS. 3 and 4 but air is delivered from pumping apparatus 41 through ducts 42 connected to an inlet manifold 43 arranged along one edge of the barrier 10 so as to communicate with the interspace 16 along a substantial proportion of that edge. In addition, an outlet manifold 44 is provided along the opposite edge of the barrier and arranged to receive air therefrom. The outlet manifold may be connected via ducts 45 to further pumping apparatus, not shown.

In use of this arrangement, a positive pressure differential is again created across the barrier membrane 12 by the pressurization of the interspace 16, opposing the flow of contaminant gases from the underlying ground into the building 40.

We claim:

1. A system for use in preventing a flow of gas from a gas-containing region to an adjacent region, comprising a composite barrier installed so as to separate the two regions, the composite barrier comprising a gas-impermeable layer including at least one aperture and a gas-permeable membrane defining an interspace between the gas-impermeable layer and the gas-permeable membrane and arranged with the permeable membrane facing the gas-containing region, means for restricting the movement of the gas at the perimeter of the composite barrier, said restricting means comprising the interspace between the impermeable layer and the permeable membrane being closed entirely around the perimeter of the barrier apart from the at least one aperture, and pumping means connected to the at least one aperture of the composite barrier communicating with the interspace for pumping the gas into the interspace so as to create a pressure differential across the permeable membrane whereby to cause the gas to flow therethrough across at least a major portion of the surface of the permeable membrane.

2. A system as claimed in claim 1, in which the composite barrier comprises a membrane of non-woven fibrous material secured to a plurality of upstanding projections extending from the impermeable layer.

3. A system as claimed in claim 2, in which the said upstanding projections of the impermeable layer are formed as embossments thereof.

4. A system for use in preventing a flow of gas from a gas-containing region to an adjacent region, comprising a composite barrier installed so as to separate the two regions, the composite barrier comprising a gas-impermeable layer and a gas-permeable membrane defining an interspace between the gas-impermeable layer and the gas-permeable membrane and arranged with the permeable membrane facing the gas-containing region, means for restricting the movement of the gas at the perimeter of the composite barrier, the composite barrier being laid horizontally under a building with the permeable membrane facing downwards, and the system including means for delivering localized pressure differential regions at a number of points distributed over the area defined by the composite barrier.

* * * * *